United States Patent [19]

Hogg

[11] 4,422,608

[45] Dec. 27, 1983

[54] PANEL HANGER

[75] Inventor: James W. Hogg, Nashville, Tenn.

[73] Assignee: Anchor Wire Corporation of Tennessee, Goodlettsville, Tenn.

[21] Appl. No.: 268,499

[22] Filed: May 29, 1981

[51] Int. Cl.[3] ..... A47F 5/00

[52] U.S. Cl. ..... 248/205 A; 248/216.4; 248/221.2

[58] Field of Search ..... 248/216.4, 467, 217.2, 248/225.1, 221.2, 222.2, 218.2, 218.3, 71, 546, 205 A, 467

[56] References Cited

U.S. PATENT DOCUMENTS

| | | | |
|---|---|---|---|
| 241,991 | 5/1881 | Jones . | |
| 2,789,783 | 4/1957 | Jones | 248/220 |
| 3,094,892 | 6/1963 | Topf | 85/2.4 |
| 3,193,225 | 7/1965 | Terlinde | 248/221.2 |
| 3,193,231 | 7/1965 | Curry | 248/205 A |
| 3,219,302 | 11/1965 | Smith | 248/220 |
| 3,300,173 | 1/1967 | Kennedy, Jr. | 248/467 |
| 3,315,816 | 4/1967 | Mallory | 248/225.1 |
| 3,319,917 | 5/1967 | Bilodeau | 248/221.2 |
| 3,401,909 | 9/1968 | Kalahar | 248/221.2 |
| 3,477,677 | 11/1969 | Hindley | 248/205 R |
| 3,637,181 | 1/1972 | Janssen | 248/205 A |
| 3,954,243 | 5/1976 | Sharp et al. | 248/235 |
| 4,103,854 | 8/1978 | Pliml et al. | 248/235 |

FOREIGN PATENT DOCUMENTS

| | | | |
|---|---|---|---|
| 37392 | 7/1923 | Norway | 248/217.2 |

*Primary Examiner*—William H. Schultz
*Assistant Examiner*—Ramon O. Ramirez
*Attorney, Agent, or Firm*—Fisher, Christen & Sabol

[57] ABSTRACT

A vertical panel hanger comprising a needle point penetrator positioned to engage the rear surface of a panel to prevent removal of the hanger, a foot portion adapted to extend between the front and rear surface of the panel to prevent vertical movement, a shank connected at a right angle to the foot portion at the shank's upper end, a hook being defined at the shank's lower end, the shank being attached to a disc whose rear surface is covered with pressure sensitive adhesive that engages the front surface of the panel to prevent lateral movement.

12 Claims, 12 Drawing Figures

PANEL HANGER

BACKGROUND OF THE INVENTION

1. Field of the Invention

This invention relates to hangers arranged to be secured to hollow doors or wall panels and is more specifically concerned with improvements in hangers of the type that are designed for application to hollow doors without the need for tools and causing minimum damage to the door or panel.

2. Brief Description of the Prior Art

A very popular type of door used in homes, offices and other buildings is the hollow wooden door comprising thin front and rear spaced apart wooden panels, for example, about ⅛" thick, which are joined to a wooden frame, for example, having a thickness of about 1⅝", so that the front and rear panels are spaced apart by the thickness of the frame. Doors of this type are widely used, are of excellent quality but have the drawback that it is very difficult if not impossible to reliably attach a hook or other hanging fixture to the door, mainly because of the thinness of the panels and all work must be done from the exterior surface of the panel since there is no access to the inner surface. Straight nail types of fixtures quickly pull down and out because the ⅛" or so thickness is incapable of holding the nail securely. The same applies to screw type hangers.

Similar problems arise when trying to secure nail or screw type hangers to wall panels which are attached to the walls of a room by nailing or adhesives. Usually a network of firring strips are first applied to the existing wall and then the wall panels are fixed to the firring strips by nails or adhesives. Thus, the panels for the most part are spaced away from the existing wall by the thickness of the firring strips which usually is about ½" or so. Nails or screws driven into the panels for attaching hanging devices soon work loose permitting the hanging device and object hung on it to fall.

This has been a continuing problem and much time, thought and effort has been expended to develop a reliable hanger for hollow wooden doors and wall panels with little or no success.

A common fault and disadvantage inherent in hangers of the conventional type resides in the tendency of the hanger to periodically move laterally when weight is put upon it. This lateral movement causes the supporting hole in the door panel to become enlarged thereby reducing the anchoring capacity of the hanger. As a result, the hanger is often so loose that it is unreliable and cannot be depended upon to properly support the weight which is put upon it. Another fault and disadvantage inherent in hangers of the conventional type resides in the tendency of the hanger to pivot in the supporting hole when weight is put upon it, causing the supporting hole in the door or panel to become enlarged thereby reducing the anchoring capacity of the hanger.

U.S. Pat. Nos. 2,723,815 and 3,300,173 disclose picture hangers anchored by conventional nails cooperating with disc shaped body portions whose rear surfaces are covered with pressure sensitive adhesive. These hangers utilize a conventional nail, and do not have the capacity to support as much weight as the subject hanger utilizing a needle point penetrator cooperating with a foot portion to provide for added support. The hangers of these patents are subject to failure by reason of the nail pulling out of the panel or cutting vertically into the panel until the nail is in suitable position for pulling out by action of gravity.

U.S. Pat. Nos. 241,991; 1,445,372; 2,789,783 and 3,219,302 variously teach hangers which utilize a face plate or ferrule abutting the wall adjacent the hanger end, but do not provide for pressure sensitive adhesives or any other reliable means to hold the hanger against pivotal or lateral movement on the wall, nor do they provide increased bearing surface for the foot portion. The first three named patents utilize oversized holes. U.S. Pat. No. 1,445,372 is especially unreliable because an upward force can easily pivot the hook out of position and result in unpositioning the ferrule. The ferrules of the other two patents simply serve to cover up the hole in the wall and provide no substantial bearing support for the hook.

Other types of hooks are of the peg board type which require predrilled holes. Such hooks are disclosed in U.S. Pat. Nos. 3,094,892; 3,392,949; 3,718,101; 3,954,243 and 4,103,854. None of these hooks are suitable for use on hollow doors or wall panels because they are temporary in nature and designed for easy removal. Hooks requiring access to both sides of the panel are described in U.S. Pat. Nos. 947,489 and 1,665,785.

SUMMARY OF THE INVENTION

The instant invention relates generally to hangers and, more specifically, is concerned with hangers that are arranged to be secured to a hollow door or wall panel, preferably a hollow wooden door having spaced apart front and rear panels joined along the top, bottom and sides of the panels to a wooden frame. The hangers of this invention comprise a single length of metal, e.g. a wire, formed to provide a needle point penetrator at one end adapted to be inserted into and through a door's panel or a wall panel and engage the inner surface of said first panel or wall panel to prevent the hanger from being pulled outwardly. The penetrator is connected to the inner end of a horizontal foot portion which extends between the inner and outer surfaces of the door's first panel to provide against vertical movement. A shank portion is attached to and extends downwardly from the outer end of the foot portion, the lower end of said shank defining a hook portion. The shank, along a substantial portion of its length, is shaped into the form of a disc, or is attached to a disc, whose rear surface is flat and is covered with pressure sensitive adhesive that engages the outer surface of the door's first panel or wall panel to resist lateral swinging movement of the hanger.

An object of the invention is to provide a hanger of such construction that the supporting hole in the door or wall panel will not be enlarged because the hanger resists periodic lateral swinging movement.

Another object of the invention is to provide a hanger of such construction that the supporting hole in the door or wall panel will not be enlarged because pivoting motion of the foot portion is avoided.

A further object of the invention is to provide a hanger that can support far more weight than the conventional slanted nail or screw hanger of equivalent size.

Another object of the invention is to increase the horizontal bearing surface for the foot member by lengthening the foot member and supporting the lengthened portion with the disc and/or by increasing the thickness of the disc. The increased bearing surface supplied to the foot member by the disc considerably increases the weight capacity of the hanger.

A still further object of the invention is to provide a hanger which is so arranged as to present a pressure distributing contacting surface uniformly around the supporting foot member.

Further objects of the invention will be brought out in the following specification, wherein a detailed description is given for the purpose of fully disclosing the invention without placing limitations thereon.

DETAILED DESCRIPTION OF THE PREFERRED EMBODIMENTS

Figure 1:
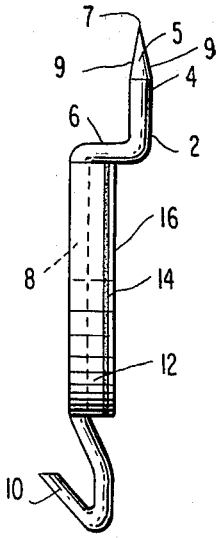
FIG. 1 is a side view of a preferred hanger embodying the features of the present invention.

Referring to FIG. 1, there is shown a preferred hanger of the invention comprising a wire 2 of suitable thickness for example, 0.0625" or 0.125" in diameter, formed with a needle point penetrator portion 4 at one end thereof, a foot portion 6 connected at right angles to the needle point penetrator portion, and a shank 8 connected at right angles to the foot portion 6 and terminating in a hook 10. The shank 8 is embedded in and secured to a disc 12 which in this case is of an oblong shape but can be of any desired shape for decoration or any other suitable purpose. The rear surface of disc 12, i.e. the surface closest to the needle point penetrator portion 4, is the surface which is intended to contact the outer surface of the panel to which the hanger is to be attached, is coated with a layer of a suitable adhesive 14, in this case a pressure sensitive adhesive which is covered with a release sheet 16 such as wax paper. Any suitable adhesive can be used, for example, water activated adhesives are suitable. The disc 12 itself can be made of any suitable material such as plastic, wood or metal. The wire 2 can be made of any suitable material, preferably metal, although strong break resistant plastics can also be used. It is convenient to use a relatively rigid metallic wire for the wire 2 and those skilled in the art would have no difficulty selecting a suitable material.

Figure 2:
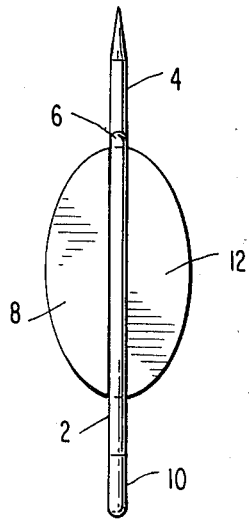
FIG. 2 is a front elevational view of the hanger shown in FIG. 1.
Figure 3:
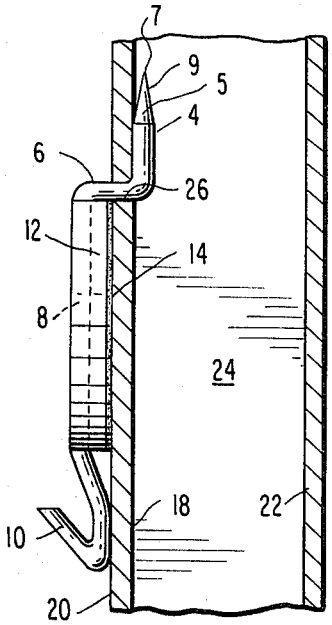
FIG. 3 is a sectional view of the hanger of FIG. 1 shown secured to a panel of a hollow door.
Figure 4:
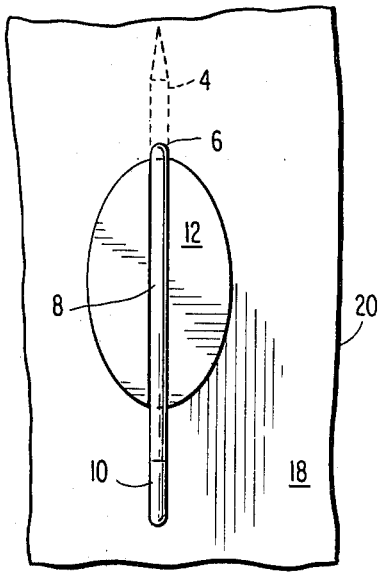
FIG. 4 is a front view in partial section of the hanger shown in FIG. 3 as applied to a hollow door.

FIGS. 3 and 4 illustrate the hanger of FIGS. 1 and 2 as secured to one panel 18 of a hollow wooden door 20, the other panel of which is designated as 22. The two panels are secured in a spaced apart relationship by means of framing 24 which usually is wooden. The needle point penetrator portion of the hanger shown in FIGS. 1–4 is pushed through the panel 18 to form a hole 26 in panel 18 or the hole 26 can be predrilled with any suitable tool such as a hand drill or power drill. After insertion of the penetrator portion through hole 26 in panel 18, the wire 2 is moved downwardly to bring penetrator portion 4 adjacent to and in contact with the inner surface of the panel 18. At the same time the pressure sensitive adhesive coated surface 14 is moved adjacent to and into contact with the outer surface of panel 18, that is, the hanger takes the position shown in FIG. 3. Prior to pressing the disc 12 up against the outer surface of panel 18, the release paper 16 is removed so that the pressure sensitive adhesive layer 14 is in a position to contact the outer surface of panel 18 and thus secure the disc 12 to the outer surface.

As best seen in FIG. 3, the disc 12 being secured to the panel 18 by means of pressure sensitive adhesive 14 increases the bearing support surface for the foot portion 6. Thus, the bearing support surface of the lower surface of the hole 26 in panel 18 is approximately doubled if the portion of the disc 12 under foot portion 6 is of the same thickness as panel 18. Thus, the downward force exerted by the foot portion 6 on the lower surface of hole 26 by the weight of the object hanging from hook portion 10 is spread over a greater surface and the pressure, in terms of pounds per square inch, operating on the lower surface of hole 26 is reduced and effectually transferred to the disc 12, adhesive 14 and the outer face of the panel 18 covered by the disc 12. As a consequence, greater weights can be supported on the hook portion 10 before reaching the rupture point of the panel 18 adjacent hole 26. Furthermore, the right angular positions of penetrator portion 4 to the foot portion 6 and of the foot portion 6 to the shank 8 and disc 12 tends to cause the weight of the object on hook portion 10 to force the disc 12 and adhesive 14 into closer contact with the outer surface of panel 18. This increases the frictional and adhesive force between the disc 12 and the outer surface of panel 18 thus increasing the restriction of movement, e.g., downwardly and/or sidewardly, of the disc 12 relative to the panel 18 and thereby increasing the vertical load supporting contribution of disc 12 for foot portion 6. The disc 12 of course can be made with any desired thickness and the foot portion can be lengthened or shortened to accommodate greater or lesser thicknesses of the disc portion below the foot portion 6. As a practical matter, the thickness of disc 12 preferably can be one-half to four times, most preferably one to two times or less of, the thickness of panel 18.

It is also best noted in FIG. 3 that the hook portion 10 is angled back towards the panel so that the weight of the object to be supported by the hook is concentrated as close to the panel 18 as possible, thereby reducing the moment arm acting on penetrator portion 4 to pivot it outwardly against the inner surface of panel 18. This considerably reduces the pressures brought to bear on the surfaces of hole 26 as well as reduces the tendency for hole 26 to open up because of such pressures. This enables the support of heavier objects by a hanger of substantially the same size as a hanger in which the hook portion is spaced from the panel 18 so as to create an increased moment arm.

Additionally, the pressure sensitive adhesive 14 prevents lateral or swinging movement of the hanger which further reduces the danger of the hole 26 opening up which ultimately would result in the hanger becoming unsecured and possibly allowing the object supported by the hanger to fall with the hanger pulling out.

Figure 5:
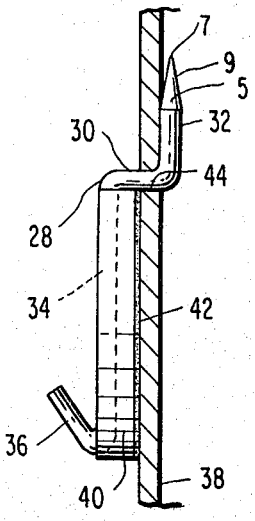
FIG. 5 is a side elevational view in partial section showing another embodiment of a hanger showing features of the present invention as secured to a panel.
Figure 6:
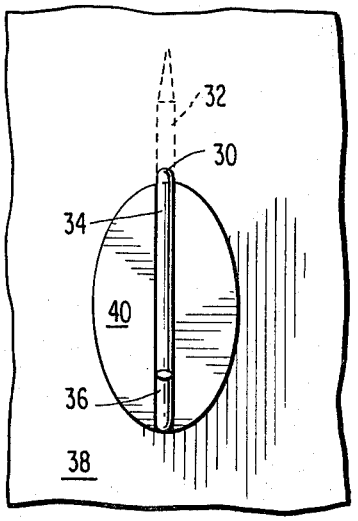
FIG. 6 is a front elevational view in partial section of the hanger shown in FIG. 5.

Referring to FIG. 5, a further embodiment is shown in which the hanger comprises a wire 28 having a foot portion 30, a needle point penetrator portion 32, a shank 34 and a hook portion 36. In this embodiment the hook portion 36 is spaced from panel 38 which can be a wall panel or one of the panels of a wooden hollow door by means of a portion of the thickness of a disc 40 which is secured to the outer face of panel 38 by means of pressure sensitive adhesive 42. In this case as in the case described above, the shank 34 is embedded in the disc 40. In this embodiment the foot portion 30 passes through a hole 44 in the panel 38; the hole 44 having been formed by pushing the penetrator portion 32 through the panel 38 or having been formed by a separate drilling operation. The foot portion in this embodiment is supported not only by the lower surface of hole 44 but also by the thickness of the disc 40 lying under the foot portion 30. In this embodiment, however, the load on the hook, when an article is suspended thereon, is at the end of a greater moment arm than that presented by the embodiment shown in FIGS. 1–4. Thus, while the embodiment of FIGS. 5 and 6 would be less capable of supporting heavier loads than the embodiment of FIGS. 1–4, it still provides a very substantial improvement in load carrying capacity as compared to the prior art hangers which have been described hereinabove. In this embodiment the pressure sensitive adhesive 42 prevents swinging of the hanger in the hole 40 or any other movement which would tend to enlarge the hole 44 and lead to the ultimate failure of the hanger to remain secured to the panel 38.

Figure 7:
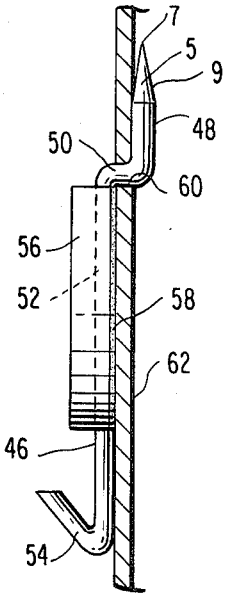
FIG. 7 is a side elevational view in partial section showing a third embodiment of a hanger of the present invention as secured to a panel.
Figure 8:
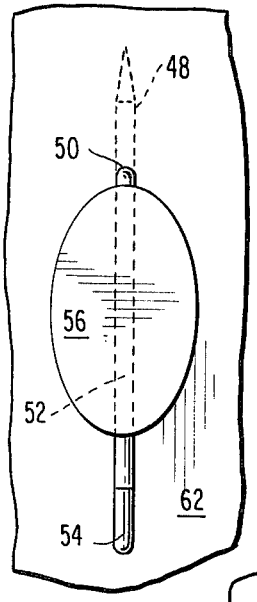
FIG. 8 is a front elevational view in partial section of the hanger shown in FIG. 7.

The embodiment shown in FIGS. 7 and 8 includes a wire 46 formed with a needle point penetrator portion 48, a shorter foot portion 50 than that of the embodiments of FIGS. 1–5, shank portion 52 and hook portion 54. The shank 52 is embedded in the rear surface of disc 56. A pressure sensitive adhesive 58 covers the rear surface of disc 56 as well as the surface of shank 52 exposed at the rear surface of disc 56. The foot portion 50 passes through a hole 60 formed in panel 62 and is supported substantially totally by the lower surface of the hole 60. The embodiment of FIGS. 7 and 8 differs from the embodiments described in FIGS. 1–6 in that the disc does not provide any substantial load bearing surface for the foot portion 50 although it does support to a certain extent the shank 52. The embodiment of FIGS. 7 and 8, however, has the advantage over the embodiment of FIGS. 5 and 6 of maintaining the hook portion 54 as close to panel 62 as possible thereby reducing the moment arm of the load on the hook portion and reducing the resulting pressures applied against the panel at the location of the hole 60.

Figure 9:
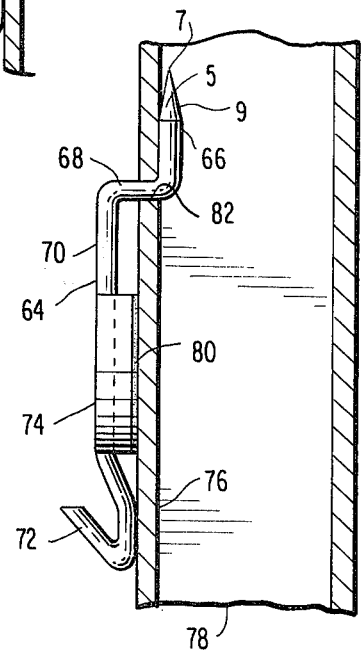
FIG. 9 is a side elevational view in partial section of a fourth embodiment of the invention as secured to a hollow door.
Figure 10:
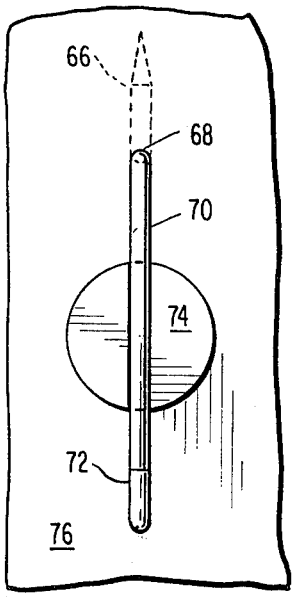
FIG. 10 is a front elevational view in partial section of the hanger shown in FIG. 9.

The embodiment of FIGS. 9 and 10 comprises a wire 64 comprising a needle point penetrator 66, a foot portion 68, a shank 70 and a hook portion 72. The shank 70 is embedded in a disc 74 which is secured to a panel 76, for example, of a hollow door 78 by means of pressure sensitive adhesive 80. The foot portion 68 passes through a hole 82 formed in the panel 78 by forcing needle point penetrator 76 through said panel or by predrilling. Also in this instance the disc 74 is circular as compared to the oblong discs of the embodiments of FIGS. 1–8.

Figure 11:
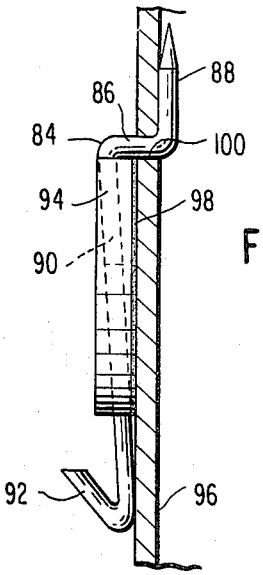
FIG. 11 is a side elevational view in partial section of a fifth embodiment of the invention as secured to a panel.
Figure 12:
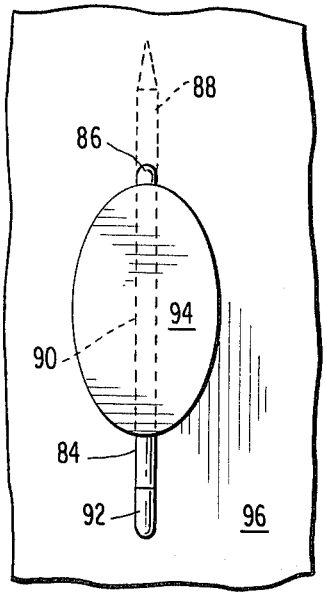
FIG. 12 is a front elevational view in partial section of the hanger shown in FIG. 11.

Referring to FIGS. 11 and 12, a fifth embodiment is shown in which the hanger comprises a wire 84 having a foot portion 86, a needle point penetrator portion 88, a shank 90 and a hook portion 92. The shank 90 passes through a disc 94 beginning at the front top of the disc and extending through the disc to the bottom rear of the disc such that the foot portion 86 is partially supported by the top edge of the disc 94 and the shank 90 emerges from the bottom of the disc 94 adjacent to panel 96. A pressure sensitive adhesive 98 is disposed on the rear surface of disc 94 and secures to the panel against lateral swinging movement. The foot portion 86 passes through hole 100 in the panel 96, said hole having been made by penetration of the needle point penetrator portion through the panel. In this embodiment the foot portion 86 is provided with additional bearing surface support contributed by the disc 94 as well as the hole 100 and at the same time presents the hook portion 92 as close as possible to the panel 96 with the minimum amount of bends in the wire 84.

The discs 12, 40, 56, 74 and 94 of the embodiments described above can be of any suitable material including wood, metal, plastic, cardboard or any other suitable material. The shape of the discs can be varied as desired and can take the shape of a circle, an oblong, a square, a rectangle, a triangle or any other geometric shape such as flower designs, animal designs, plant designs, fish designs, bird designs, etc.

The wires 2, 28, 46, 64 and 84 can be of circular cross-section or it can be flat or it can be square or flat-rectangular in cross-section. Moreover, the wires and discs can be a single unitary object, e.g. molded or cast plastic or metal, or they can be separate but suitably adhered together either by an adhesive, soldering, welding, brazing, etc. Preferably the hooks 10, 36, 54, 72 and 92 are sufficiently rigid and strong to support the weight which it is desired to support and of course the corresponding penetrator portions and foot portions also must be sufficiently rigid to resist deformation when load is applied to the hook.

Dimensions of the discs and the wires are not narrowly critical as long as adequate strength is provided for the purposes of supporting the loads for which the hooks are specifically designed. Hangers having circular discs having a $\frac{5}{8}''$ diameter and a thickness of about 0.11" and wires having a thickness of about 0.0625" in diameter have been found to be suitable for supporting twenty pound loads. Hangers having circular discs of about $\frac{3}{4}''$ in diameter and wires of about 0.0625" in diameter and made of 1065 spring steel have been found to be suitable for supporting forty pound loads. Alternatively, the discs can be oval shaped about $1\frac{1}{2}''$ long and about $1\frac{1}{4}''$ wide. In addition, the hook portions 10, 36, 54, 72 and 92 of the embodiments described can be made much longer, e.g. they can extend outwardly approximately $1\frac{1}{2}''$ for the purpose of supporting coats or other articles of apparel. In this case the wire should be heavy enough, for example, approximately #9 so as to have adequate strength to support the weight of the coat or like object. The shortest distance between the plane of the rear surface of the discs 12, 34, 56, 74 and 94 and the penetrator portions 4, 32, 48, 66 and 88 should be substantially the same or slightly less than the thickness of the panel to which the hanger is intended to be applied.

This will provide a snug clamping action to tightly hold the panel between the penetrator portion and the rear surface of said discs. The weight of the object exerted on hook portions 10, 36, 54, 72 and 92 will increase the pressure of said penetrator portions on the inner surfaces of the respective panels and the pressure of the rear surface of said discs on the outer surface of said panels thereby resisting any movement of the hanger in respect to the panel.

Preferably the needle point penetrator portions 4, 32, 48 and 66 are each formed with at least one planar surface 5 tapering down to a needle point 7 defined by coinciding, sharp cutting edges 9 which facilitate penetration of the panel by twisting or rotating the needle point against the panel. Moreover, the penetrator portions 4, 32, 48 and 66 are adapted to engage the interior surface of the panel, in which the hanger is installed, along the substantially entire length of said penetrator portions.

As a further modification of the present invention, the hook portion 10 can be replaced with another object such as a door knocker or an ornamental figure, e.g. animal head design, or a small vase or the like.

While the invention has been described with particular reference to the specific embodiments, it is to be understood that it is not to be limited thereto but is to be construed broadly and restricted solely by the scope of the appended claims.

What is claimed is:

1. In a hanger for suspending articles from a vertical panel having a front and rear surface, said device comprising a disc having a front and rear surface and a wire having an upwardly projecting needle point penetrator portion disposed in a plane parallel with the planes of said disc's front and rear surfaces to permit forcible insertion through said panel and by manipulation to abut against the panel's rear surface thereof to prevent removal of the hanger, a foot portion projecting outwardly from the lower end of said penetrator portion and at a substantially right angle thereto to extend between the front and rear surfaces of said panel to provide support against vertical movement, that portion of said wire extending forwardly through said front surface of the panel when said penetrator portion abuts against said rear surface being connected to said disc to press said disc against said front surface of the panel, said wire further depending downwardly from said foot portion to define a shank, said shank defining a hook at its lower end, said disc having a rear surface provided with an adhesive covering for adhesion to the front surface of said panel to prevent relative movement of said disc.

2. A device as described in claim 1, wherein said adhesive covering the rear surface of said disc is pressure sensitive.

3. A device as described in any one of claims 1 or 2, wherein said foot portion and said hook are connected by a shank attached to the front surface of said disc.

4. A device as described in either one of claims 1 or 2, wherein said hook is formed to engage against the front surface of said panel below said disc, displacing some of the weight put upon said hook inwardly against the front surface of said panel.

5. A device as described in either one of claims 1 or 2, wherein said foot portion is disposed above and supported by said disc.

6. A device as described in any one of claims 1 or 2, wherein said shank is embedded in the front surface of said disc.

7. A device as described in claim 3, wherein said hook is formed to engage against the front surface of said panel below said disc, displacing some of the weight put upon said hook inwardly against the front surface of said panel.

8. A device as described in claim 3, wherein said foot portion is disposed above and supported by said disc.

9. A device as described in claim 3, wherein said shank is embedded in the front surface of said disc.

10. A device as described in claim 4, wherein said shank is embedded in the front surface of said disc.

11. A device as described in claim 5, wherein said shank is embedded in the front surface of said disc.

12. A device as described in claim 6, wherein said shank is embedded in the front surface of said disc.

* * * * *